United States Patent [19]

Wakamatsu et al.

[11] Patent Number: 4,667,814

[45] Date of Patent: May 26, 1987

[54] OXYGEN ABSORBENT PACKET

[75] Inventors: Syuji Wakamatsu; Toshio Komatsu; Yoshiaki Inoue, all of Tokyo; Yoshihiko Harima, Chiba, all of Japan

[73] Assignee: Mitsubishi Gas Chemical Company, Inc., Japan

[21] Appl. No.: 790,046

[22] Filed: Oct. 22, 1985

[30] Foreign Application Priority Data

Oct. 24, 1984 [JP] Japan ..... 59-223789

[51] Int. Cl.[4] ..... F17C 11/00

[52] U.S. Cl. ..... 206/0.7; 206/204; 206/438; 206/524.1; 206/524.2; 215/232; 220/359; 428/35

[58] Field of Search ..... 206/0.7, 204, 205, 438, 206/524.1, 524.2, 524.4; 215/232; 220/359

[56] References Cited

U.S. PATENT DOCUMENTS

| | | | |
|---|---|---|---|
| 2,026,937 | 1/1936 | Eisen | 215/43 |
| 2,842,223 | 7/1958 | Zall | 183/4 |
| 3,211,667 | 10/1965 | Coyne | 252/392 |
| 3,767,076 | 10/1973 | Kennedy | 215/40 |
| 3,826,358 | 7/1974 | Butler et al. | 206/204 |
| 4,236,633 | 12/1980 | Ernerot | 206/213.1 |
| 4,279,350 | 7/1981 | King | 215/228 |
| 4,418,834 | 12/1983 | Helms et al. | 220/359 |
| 4,421,235 | 12/1983 | Moriya | 206/524.2 |
| 4,497,406 | 2/1985 | Takanashi | 206/438 |

*Primary Examiner*—John E. Kittle
*Assistant Examiner*—Patrick J. Ryan
*Attorney, Agent, or Firm*—Leydig, Voit & Mayer

[57] ABSTRACT

In an oxygen absorbent packet, an oxygen absorbent containing moisture is received in the cup like plastic container and an air-permeable layer made of paper is adhered to the opening section of the container. A substantially air-impermeable layer is formed on the outer surface of the air-permeable layer, whereby the oxygen absorbent absorbs oxygen through the peripheral side edge of the air-permeable layer.

10 Claims, 2 Drawing Figures

OXYGEN ABSORBENT PACKET

BACKGROUND OF THE INVENTION

The present invention relates to an oxygen absorbent packet for packing an oxygen absorbent, and, more particularly, to an oxygen absorbent packet suitable for storage together with drugs in a sealed container.

When drugs such as some antibiotics, vitamins, live bacteria drugs, enzyme drugs and crude drugs are stored, the drugs may be oxidized or discolored and their effects are often degraded. In order to prevent oxidation of the drugs, according to conventional techniques, an antioxidant agent is added to drugs, drugs are encapsulated, or drug pills are covered with a coating. Since the conventional antioxidation techniques are not completely satisfactory, an oxygen absorbent is used in some cases. However, the following problem is presented by the method using an oxygen absorbent.

In general, most granular or solid drugs have a small water content and tend to degrade due to humidity. For this reason, these drugs must be kept in a dry state, and a desiccant is often used.

When a drug kept dry by means of a desiccant is stored with an oxygen absorbent, the water-containing oxygen absorbent must be held together with the drug and the desiccant is a single sealed container. In this state, moisture contained in the oxygen absorbent is absorbed by the drug or the desiccant to decrease the oxygen absorption rate. In the worst case, the oxygen absorption reaction is interrupted. In general, drugs must withstand a high-temperature (40° C. or more) test under pharmaceutical regulations. When an oxygen absorbent is used under such a severe condition, the moisture is absorbed from the oxygen absorbent by the drug or desiccant, and thus degradation of the drug is inevitable.

A conventional oxygen absorbent is packed with an air-permeable packing material. On the other hand, most of the drugs must be protected from humidity. Evaporation of water from the oxygen absorbent must therefore be minimized. At the same time, the oxygen absorption effect must be maintained. The air permeability of a packing material is preferably 60,000 to 80,000 sec/100 ml air in compliance with JIS P8117. The air permeability of a packing material having a large surface area is difficult to maintain within this range. Most commercially available granular and pill type drugs are contained in small bottles or cans. When the oxygen absorbent is packed in a small package, productivity efficiency is degraded and the other appearance of the packet is poor. Moreover, an oxygen absorbent is too large to be sealed in a sealed container.

SUMMARY OF THE INVENTION

It is an object of the present invention to provide an oxygen absorbent packet for packing an oxygen absorbent, wherein evaporation of the oxygen absorbent into an ambient atmosphere can be properly controlled, air permeability can be provided, and an oxygen absorption reaction can be properly maintained.

According to the present invention, there is provided an oxygen absorbent packet comprising:

an oxygen absorbent containing moisture;

a cup-like plastic container having an opening section defining an opening;

an air-permeable layer having inner and outer surfaces and a peripheral side edge, the air-permeable layer being made of a material selected from the group consisting of paper, nonwoven fabric and microporous film, the air-permeable layer covering the opening of the container so as to provide air permeability with a relatively high degree of resistance to humidity-permeation;

means for adhering the inner surface of the air-permeable layer to the opening section of the container; and a substantially air-impermeable layer made of a material having a relatively high degree of resistance to air-permeation positioned on the outer surface of the air-permeable layer, whereby the oxygen absorbent absorbs oxygen through the peripheral side edge of the air-permeable layer.

DETAILED DESCRIPTION OF THE PREFERRED EMBODIMENTS

Figure 1:
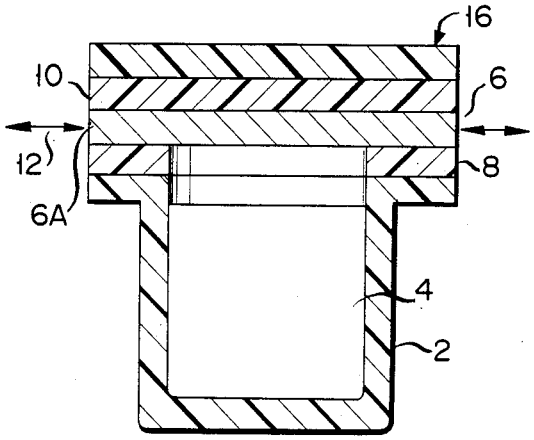
FIG. 1 is a sectional view of an oxygen absorbent packet containing an oxygen absorbent according to an embodiment of the present invention.

FIG. 1 is a sectional view of an oxygen absorbent packet containing an oxygen absorbent according to an embodiment of the present invention. A solid oxygen absorbent 4 containing moisture is stored in a blister-molded cup-like plastic container 2. The container 2 is made of polyethylene, polypropylene, polyvinyl chloride, polyethylene terephthalate, polamide, polystyrene or the like, and has a thickness of 20 to 500 μm. The oxygen absorbent 4 is made of, as a major constituent, a metal (e.g., iron), an organic compound (e.g., hydroquinone, ascorbic acid, erythorbic acid, or catechol), or a reducible sulfur compound (e.g., sulfite or dithionite).

An opening section of the container 2 defines an opening and is ahered by an adhesive 8 to an air-permeable layer 6 made of an air permeable material with a relatively high degree of resistance to humidity-permeation, so that the opening of the container 2 is covered. The layer 6 is made of paper or nonwoven fabric, or microporous film. In order to provide proper air permeability with a relatively high degree of resistance to humidity-permeation, a paper of nonwoven fabric layer, as the layer 6, has a unit weight of 20 g/m$^2$ to 100 g/m$^2$. However, when the layer 6 is constituted by a microporous film, the film has a thickness of 50 μm to 200 μm. The nonwoven fabric can be manufactured in accordance with a dry, wet or spunbond system. The material of the nonwoven fabric is preferably pulp, polyolefin, polyamide or polyester. The microporous film is made of a synthetic resin such as polyethylene, polypropylene, polyethylene fluoride or polyvinyl chloride. The microporous film employed in the practice of this invention may be prepared by: cold orientation of film; orientation of different substance-containing film; extraction of different substance from different substance-containing film; extraction of different substance-containing film, followed by orientating the so-treated film and irradiation of film with electron beam. The microporous film has micropores which do not allow water to permeate unless there is a difference between the pressure outside the packet or bag and pressure in the bag. The diameters of the micropores range from 0.01 to 50 μm, and are preferably less than 2 μm. The microporous film has a Gurley type air permeability of 0.01 to 1,000 sec/100 ml, and preferably 1 to 1,000 sec/100 ml.

Figure 2:
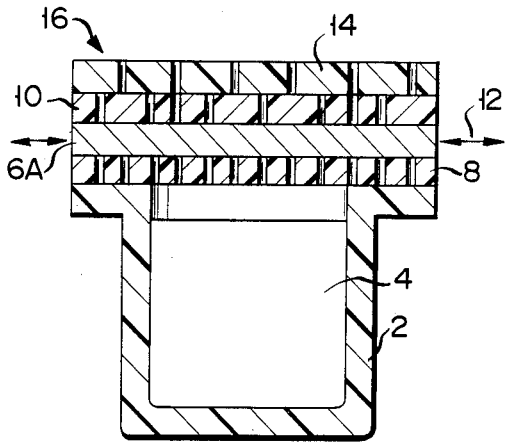
FIG. 2 is a sectional view of an oxygen absorbent packet containing an oxygen absorbent according to another embodiment of the present invention.

The adhesive 8 comprises polyolefin or a low softening point resin such as hot melt, and is applied in an amount of 3 g/m$^2$ to 50 g/m$^2$. The adhesive 8 may comprise a film or coating of 3 to 50 μm thickness, as shown in FIG. 2. When the adhesive 8 comprises a film, the film preferably has many small pores formed therein or is made of a permeable foamed film so as to improve permeability. When small pores are formed in the film, the number of pores is selected such that the porosity, i.e., the ratio of the total area of the micropores to the overall area of the film is 0.001% or more, and preferably 0.01% or more. When polyolefin or polyvinyl chloride is mixed in the layer 6, or polyolefin or a low softening point resin such as polyolefin or polyvinyl chloride is contained in the layer 6, the adhesive 8 need not be employed and the layer 6 can be bonded directly to the opening section of the container 2.

An air-impermeable layer 10 such as a film having a thickness of from 5 to 30 μm, or a coating layer of 3 g/m$^2$ to 50 g/m$^2$ covers the upper surface of the layer 6. An edge 6A of the layer 6 is kept exposed without being covered with the layer 10 so as to assure air permeability between the interior of the container 2 and the outer atmosphere, as indicated by arrow 12. When the layer 10 comprises a film layer, the layer 10 is made of polyethylene terephthalate, polyamide, polyvinyl alcohol, polyethylene, polypropylene, polyvinyl chloride, an ethylene-vinyl acetate copolymer or the like. The layer 10 need not be constituted by a single layer, but can be a multi-layer film. When the layer 10 comprises a coating layer, it is made of nitrocellulose, cellulose acetate, chlorinated polyvinyl acetate, chlorinated polypropylene polyurethane, polyethylene, an ethylene-vinyl acetate copolymer, or polyvinylidene chloride. An aluminum foil layer or an aluminum deposition layer 14 may be formed on the layer 10.

The layers 10 and 14 can have many small pores, as shown in FIG. 2. The pores serve to adjust air permeability and the humidity-permeation resistance of the multilayer film 16 which covers the opening section of the container 2. The multilayer film 16 comprises the adhesive 8 and the layers 6 and 10.

Since the absorbent 4 is contained in the container 2 whose opening is covered by the air permeable layer 6 that has a relatively high degree of resistance to humidity-permeation, the oxygen absorbent is maintained in a moisture-containing state and can properly perform the oxygen absorbent reaction in the container. In particular, the interior of the container 2 can communicate with the exterior through the peripheral side edge 6A of the layer 6, as indicated by arrow 12. Therefore, the permeability and thickness of the layer 6 can be properly selected to control the oxygen absorbent reaction rate, and provide a proper storage period in accordance with varying types of drug. The oxygen absorbent reaction rate and the storage period of the drug can be adjusted by selecting the number of pores and the diameters thereof of the porosities formed in the air impermeable film in addition to selecting the permeability and thickness of the layer 6.

The present invention will be described in detail by way of examples.

EXAMPLE 1

A storage test for vitamin C was made wherein vitamin C granules having an overall weight of 300 mg were contained in a 50-m bottle, and an oxygen absorbent packet containing an oxygen absorbent and an oxygen sensing agent, for example, Ageless Eye (Trade Name of MITSUBISHI GAS CHEMICAL CO., INC.) was housed in a holder fixed in the inner surface of the bottle's cap. The oxygen sensing agent in the oxygen absorbent packet became pink in color within 4 days, indicating that oxygen absorption had occurred within the bottle. Within the 90 days in which the bottle contents were maintained in the above state, 95% or more of the vitamin C was maintained intact and found not to have discolored. In contrast, in a bottle not containing an oxygen absorbent container, vitamin C was decreased to 80% within 90 days, and white granules were changed in color to light yellow.

EXAMPLE 2

An oxygen absorbent packet containing an oxygen absorbent and a desiccant was placed in a holder mounted on the inner surface of a cap of a bottle containing lactic bacilli, in the same manner as in Example 1, and was subjected to a storage test. $6.4\times10^6$/gr live bacteria (beginning) were decreased to $5.7\times10^5$/gr (89%) within 3 months in the bottle containing the oxygen absorbent. However, bacteria were significantly decreased to $4.4\times10^5$/gr in a control bottle containing no oxygen absorbent, thus demonstrating a good maintenance effect on the part of the oxygen absorbent with respect to live bacteria.

EXAMPLE 3

An oxygen absorbent packet containing an oxygen absorbent was placed in a holder mounted on the inner surface of a cap of a bottle containing soft capsules of eicosapentahoic acid (EPA), in the same manner as in Example 1, and the POV (peroxide value) was measured while the bottle was stored at a temperature of 25° C. No substantial increase in the POV was found in the bottle containing the oxygen absorbent, while the POV was increased five times in a bottle containing no oxygen absorbent, thus confirming the antioxide effect of the oxygen absorbent packet.

According to the oxygen absorbent packet containing the oxygen absorbent of the present invention, moisture is scarcely transferred to a stored object, the oxygen absorption effect can be provided even in a dry state, and the oxygen absorption reaction will not be stopped during storage of the object. According to the oxygen absorbent packet of the present invention, when an iron-based oxygen absorbent is used, external evidence or iron rust will not appear. When a solid tablet oxygen absorbent is used, packing can be simplified and granules will not drop out through the packing material. Furthermore, when the packet is prepared by blister packing, the packet can be made compact and can be easily inserted in a bottle. In addition, different insertion techniques can be adapted, so that the packet will not be accidentally taken as a pill.

What is claimed is:

1. An oxygen absorbent packet comprising:

(a) an oxygen absorbent containing moisture;

(b) a cup-like plastic container having an opening section defining an opening, in which the oxygen absorbent is received; and (c) a multilayer film covering said opening comprising:

(i) an air-permeable layer having inner and outer surfaces and a peripheral side edge, the air-permeable layer being made of a material selected from the group consisting of paper, nonwoven fabric and microporous film, the air-permeable layer covering said opening of said container so as to provide air permeability with a relatively high degree of resistance to humidity-permeation;

(ii) means for adhering said inner surface of said air-permeable layer to said opening section of said container; and (iii) a substantially air-impermeable layer made of a material having a relatively high degree of resistance to air-permeation and formed solely on the outer surface of the air-permeable layer, whereby the oxygen absorbent absorbs oxygen through the peripheral side edge of the air-permeable layer.

2. A packet according to claim 1, wherein said container is made of a material selected from the group consisting of polyethylene, polypropylene, polyvinyl chloride, polyethylene terephthalate, polyamide and polystyrene.

3. A packet according to claim 1, wherein said air-permeable layer is made of one of paper and nonwoven fabric of a thickness from 20 $g/m^2$ to 100 $g/m^2$.

4. A packet according to claim 1, wherein said air-permeable layer is made of a microporous film of a thickness from 50 $\mu m$ to 200 $\mu m$.

5. A packet according to claim 1, wherein said air-impermeable layer comprises a film made of a material selected from the group consisting of polyethylene terephthalate, polyamide, polyvinyl alcohol, polyethylene, polypropylene, polyvinyl chloride and an ethylene-vinyl acetate copolymer.

6. A packet according to claim 1, wherein said air-impermeable layer comprises a multilayer film made of materials which are selected from the group consisting of, polyethylene terephthalate, polyamide, polyvinyl alcohol, polyethylene, polypropylene, polyvinyl chloride and an ethylene-vinyl acetate copolymer.

7. A packet according to claim 1, wherein said air-impermeable layer comprises a single coating layer which is made of a material selected from the group consisting of nitrocellulose, cellulose acetate, polyvinyl chloride-acetate, polyurethane, polyethylene, an ethylene-vinyl acetate copolymer and polyvinylidene chloride.

8. A packet according to claim 1, wherein pores are formed in the air-impermeable layer.

9. A packet according to claim 1, wherein an aluminum film is formed on said air-impermeable layer.

10. A packet according to claim 9, wherein pores are formed in said aluminum film and in said air-impermeable layer.

* * * * *